United States Patent [19]

Keller

[11] Patent Number: 4,881,434

[45] Date of Patent: Nov. 21, 1989

[54] TOOL FOR THREADING OVERSIZED ROPE THROUGH OPENING IN AN ELASTIC STRAP

[76] Inventor: Robert L. Keller, 8512 Keystone, Omaha, Nebr. 68103

[21] Appl. No.: 191,643

[22] Filed: May 9, 1988

[51] Int. Cl.[4] ..... B25B 7/02

[52] U.S. Cl. ..... 81/426; 81/423

[58] Field of Search ..... 81/488, 418–424, 81/424.5, 426; 29/253, 268, 270–272, 235

[56] References Cited

U.S. PATENT DOCUMENTS

| | | | |
|---|---|---|---|
| 2,725,774 | 12/1955 | Tekse | 81/423 X |
| 2,755,541 | 7/1956 | Kruger | 29/268 |
| 3,119,174 | 1/1964 | Wokeck | 29/235 |
| 3,924,507 | 12/1975 | Paroni | 85/9 R |
| 4,075,749 | 2/1978 | Hubeny | 29/268 |
| 4,222,985 | 9/1980 | Greenleaf | 422/99 |

FOREIGN PATENT DOCUMENTS

| | | | |
|---|---|---|---|
| 547728 | 9/1956 | Italy | 29/268 |

*Primary Examiner*—Debra Meislin

*Attorney, Agent, or Firm*—Henderson & Sturm

[57] ABSTRACT

A tool for threading oversized rope through an opening in an elastic strap. The tool includes a plier type implement having both upper and lower jaws which are movable between an open position and a closed position. The upper jaw has an opening formed therein and the lower jaw includes a hollow member in alignment with the upper jaw opening when the jaws are in a closed position. The outside surface of the hollow member on the lower jaw will accept an opening in an elastic strap and the inside surface of the hollow member allows an oversized rope to pass therethrough and be threaded into the opening in the elastic strap which is on the lower jaw hollow member.

9 Claims, 3 Drawing Sheets

TOOL FOR THREADING OVERSIZED ROPE THROUGH OPENING IN AN ELASTIC STRAP

TECHNICAL FIELD

This invention relates to a tool for threading oversized rope through an opening in an elastic strap.

BACKGROUND ART

Many prior art devices are known that allow threading of a rope through an opening. The problem associated with some of the prior art devices is that when the rope is inserted through an object for threading into an opening, such as an eye of a needle type object, the rope is doubled at the eye portion of the needle and this bulk is extremely difficult, if not impossible, to thread through a smaller opening.

In securing a boat cover or the like to a trailer with elastic straps, the securement means is generally a metal "S" shaped hook which runs from the elastic strap and hooks onto the trailer. The metal "S" hooks mar the surface of the boat and sometimes cause serious damage from friction of the "S" hook against the surface.

Those concerned with these and other problems recognize the need for an improved tool for threading an oversized rope through an opening in an elastic strap.

DISCLOSURE OF THE INVENTION

The present invention provides a tool for threading oversized rope through an opening in an elastic strap. The tool includes a plier type implement having both upper and lower jaws which are movable between an open position and a closed position. The upper jaw has an opening formed therein and the lower jaw includes a hollow member in alignment with the upper jaw opening when the jaws are in a closed position. The outside surface of the hollow member on the lower jaw will accept an opening in an elastic strap and the inside surface of the hollow member allows an oversized rope to pass therethrough and be threaded into the opening in the elastic strap which is on the lower jaw hollow member.

An object of the present invention is the provision of an improved tool to enable one to thread oversized rope through an opening in an elastic strap.

Another object of the present invention is to provide a tool for threading oversized rope through an opening in an elastic strap that is easy to use.

A further object of the invention is the provision of a tool for threading oversized rope through an opening in an elastic strap that is inexpensive to manufacture.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figures 1, 2, 16:
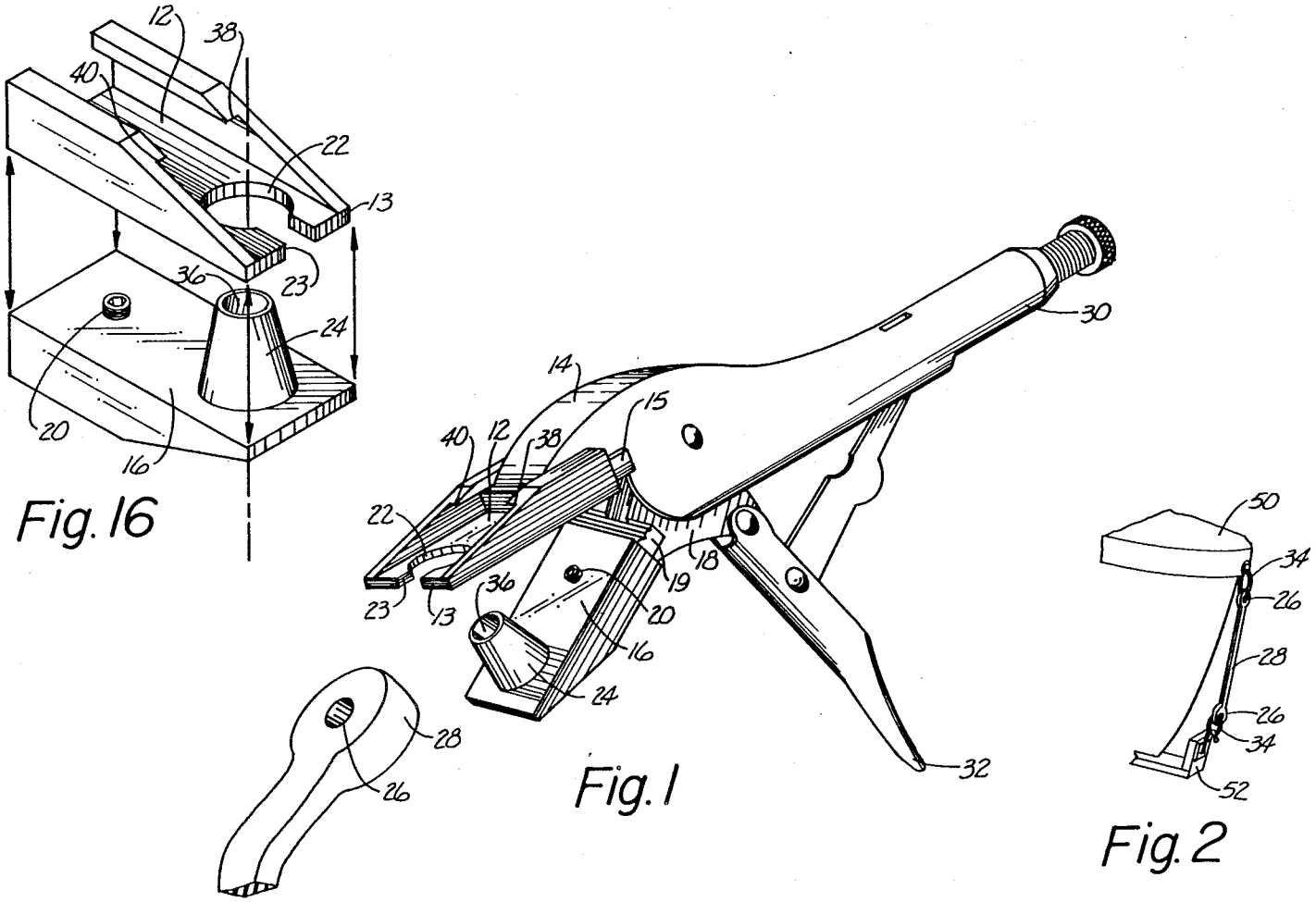
FIG. 1 is a perspective view of the tool of the present invention showing the pliers in an open position and showing a partial view of the elastic strap to be placed on the hollow cone shaped member of the lower jaw of the pliers.
FIG. 2 is a perspective view of the rope threaded through two end openings of an elastic strap securing a boat cover to a boat trailer.
FIG. 16 is a perspective view of the upper jaw attachment and lower jaw attachment with the arrows showing the direction of the movement of the jaws.

Referring now to the drawings, wherein like reference numerals designate identical or corresponding parts throughout the several views, FIG. 1 shows the tool in a fully open position depicted generally at 10. The tool (10) includes an upper jaw attachment (12) attached to the upper jaw (14) of the tool (10) by a set screw (21). The lower jaw attachment (16) is secured to the lower jaw (18) of the tool (10) by means of a set screw (20). The upper jaw attachment (12) includes a platen surface (13) having an opening (22) therein and a slot (23) extending from the opening (22) for allowing removal of a rope (34) from the tool (10). The lower jaw attachment (16) has a cone shaped hollow member (24) disposed thereon for receiving an opening (26) of an elastic strap (28).

Figures 3, 4, 5:
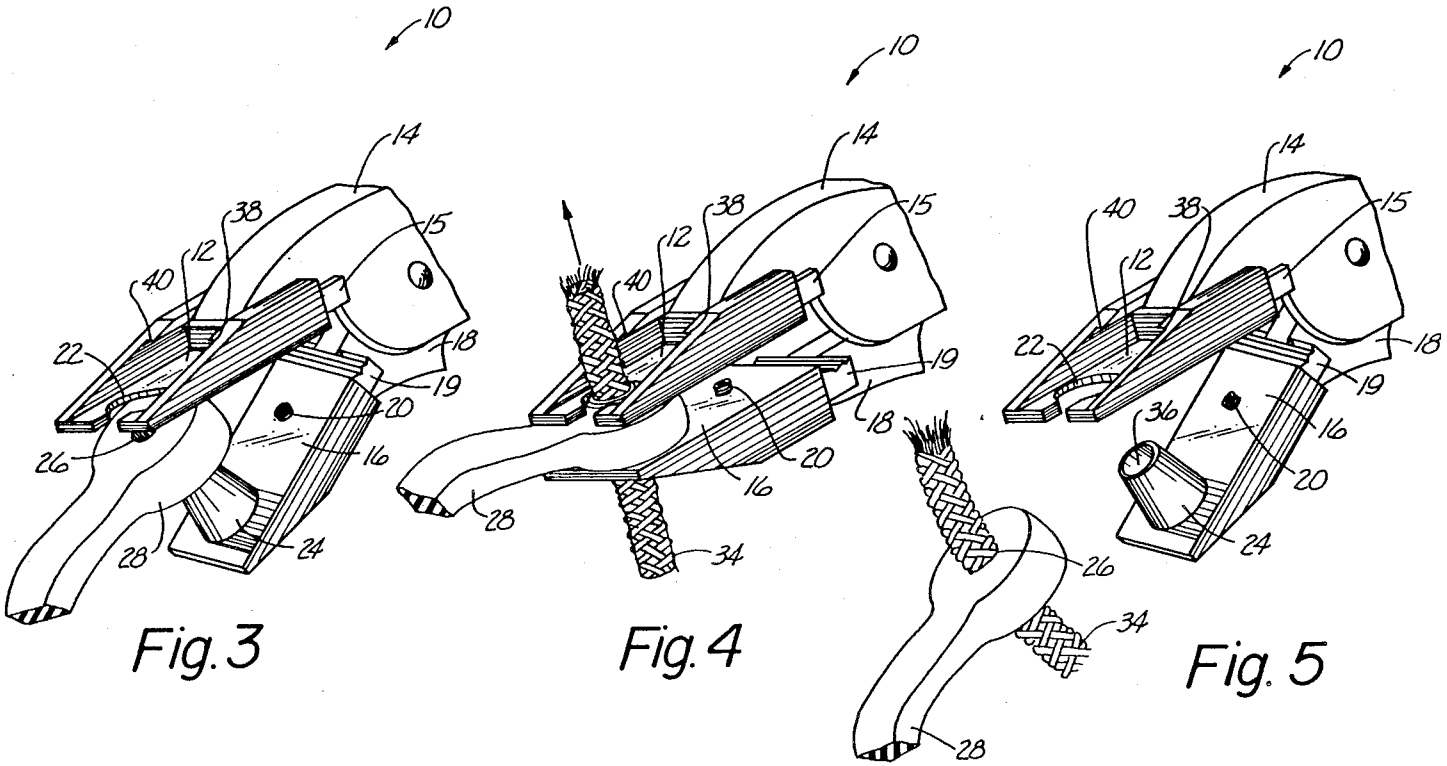
FIG. 3 is a partial perspective view of the end of an elastic strap being placed on the cone shaped member and the upper jaw member beginning to force the strap down onto the cone shaped member.
FIG. 4 is a partial perspective view of the tool in a closed position with the elastic strap positioned on the cone shaped member and a section of rope threaded up through the inside of the cone shaped member with the arrow showing the preferred direction of insertion of the rope.
FIG. 5 is a partial perspective view of the tool in an open position showing the strap removed from the cone shaped member, and showing the rope threaded through the opening in the elastic strap.

Referring now to FIGS. 3-5, it can be seen that the opening (26) of the elastic strap (28) is placed on the hollow member (24) of the lower jaw attachment (16). The tool (10) is squeezed at its handle portions (30, 32) (Fig. 1) to force the upper jaw attachment (12) down, with the opening (22) in alignment with hollow member (24) on the lower jaw attachment (16), thereby forcing the elastic strap (28) onto the outside surface of the hollow member (24) of the jaw attachment (16). FIG. 4 shows the tool (10) in a completely closed position with the elastic strap (28) firmly seated on the hollow member (24) and a section of rope (34) being fed through the inside (36) of the hollow member (24) and through the opening (22) in the upper jaw attachment (12). The pressure on the handles (30, 32) of the tool (10) is then released and FIG. 5 shows the rope (34) inserted through the opening (26) of the elastic strap (28) and removed from the hollow member (24) of the tool (10).

Figure 11:
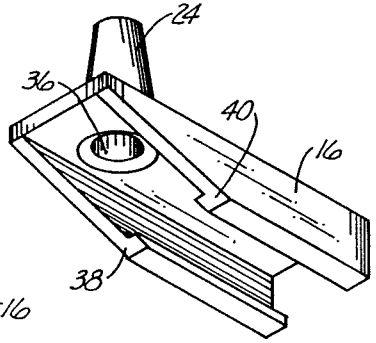
FIG. 11 is a perspective view of the lower jaw attachment showing the hollow cone shaped member and the channels.
Figure 12:
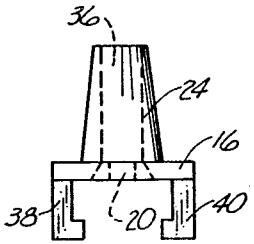
FIG. 12 is a front elevational view thereof.
Figure 15:
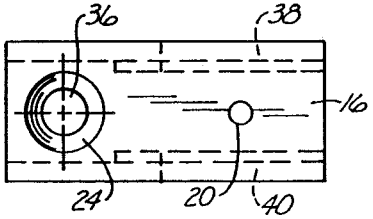
FIG. 15 is a top plan view of the lower jaw attachment with the channels shown in dashed lines.
Figure 14:
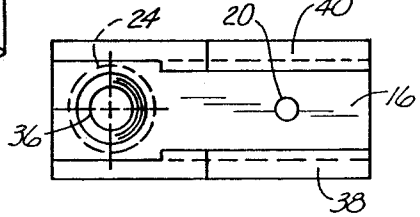
FIG. 14 is a bottom plan view of the lower jaw attachment.
Figure 13:
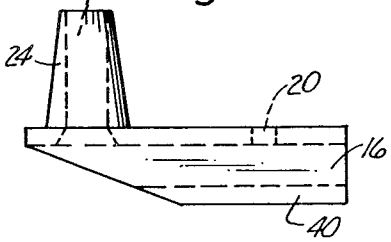
FIG. 13 is a side elevational view thereof.
Figure 6:
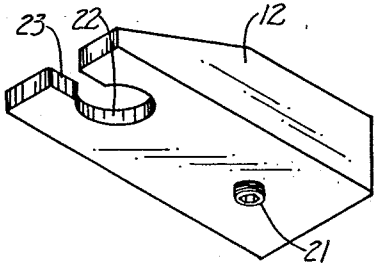
FIG. 6 is a perspective view of the upper jaw attachment of the present invention.
Figure 7:
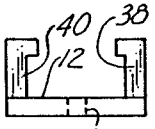
FIG. 7 is a front elevational view thereof.
Figure 10:
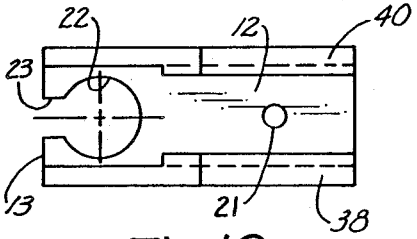
FIG. 10 is a top plan view of the upper jaw attachment.
Figure 9:
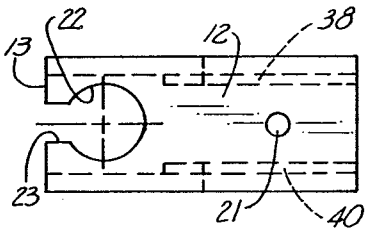
FIG. 9 is a bottom plan view of the upper jaw attachment with the channels shown in dashed lines.
Figure 8:
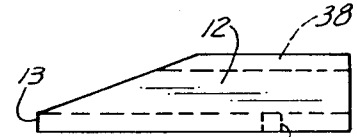
FIG. 8 is a side elevational view thereof.

FIG. 6 shows the upper jaw attachment (12) including the opening (22) and set screw (21). FIG. 11 shows the lower jaw attachment (16) with the hollow member (24) thereon. Channels (38, 40) which slidingly engage the tool (10) are shown. FIGS. 7, 8, 9 and 10 show the upper jaw attachment (12) in various views. Channels (42, 44) are also shown. FIGS. 12, 13, 14 and 15 show the lower jaw attachment (16) showing channels (38, 40) and hollow member (24) thereon.

To assemble, the channels (42, 44) of the upper jaw attachment (12) are slid into position over the enlarged laterally extending flanges (15) on the upper jaw (14) of a locking pliers device and secured with the set screw (21). Likewise, channels (38, 40) of the lower jaw attachment (16) are slid into position over the enlarged laterally extending flanges (19) of the lower jaw (18) of a locking pliers device and secured with set screw (20). It is to be understood that the features of the jaw attachments (12) and (16) could be integrally formed on the jaws of a specialized plier tool, and that plier tool designs other than the adjustable locking plier could also be used.

The operation of the tool (10) is best illustrated by reference to FIGS. 3–5. When the handles (30, 32) of the tool (10) are in an at rest position, the operator slides the opening (26) of the elastic strap (28) over the hollow member (24) of the lower jaw attachment. Pressure is then applied to the tool (10) bringing the upper jaw attachment (12) down and over the hollow member (24) of the lower jaw attachment (16), thereby forcing opening (26) of the elastic strap (28) down onto the hollow member and stretching the opening (26). A rope (34) is inserted into the underside of the hollow member (24), and pushed up through the hollow member (24) and through the stretched opening (26) of the elastic strap (28). The operator then releases the pressure on the tool (10) and the upper jaw attachment (12) returns to its at rest position. The rope (34) is then removed from the upper jaw attachment (12) by sliding it through opening (22). The opening (26) of the elastic strap (28) is then pushed off the hollow member (24). The rope (34) may then have its ends tied in some sort of secure knot and used to secure a boat covering (50) to a trailer (52) as depicted in FIG. 2.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. A tool for threading oversized rope through an opening in an elastic strap comprising:

a plier type implement having an upper jaw and a lower jaw movable between an open position and a closed position, said upper jaw including a opening therein and said lower jaw including a cone shaped hollow member having an inside surface and an outside surface, said cone shaped hollow member extending upwardly toward said upper jaw such that said cone shaped hollow member is disposed in alignment with said upper jaw opening when said jaws are in the closed position, wherein the outside surface of said cone shaped hollow member is disposed for insertion into an opening in an elastic strap and the inside surface of the cone shaped hollow member allows an oversized rope to pass therethrough and be threaded through the opening in the elastic strap.

2. The tool as described in claim 1 wherein the plier type implement is a locking plier pivotally connected at its central portion and further including handles at its rearward portions.

3. The tool as described in claim 1 wherein said upper jaw further includes a slot extending from said opening for ease of removal of the threaded rope.

4. A tool for threading oversized rope through an opening in an elastic strap comprising:

a plier type implement having an upper jaw and a lower jaw movable between an open position and a closed position, wherein said upper jaw includes an upper jaw attachment with an opening therein, and wherein said lower jaw includes a lower jaw attachment with a cone shaped hollow member having an inside surface and an outside surface, said cone shaped hollow member extending upwardly toward said upper jaw such that said cone shaped hollow member is disposed in alignment with said upper jaw attachment opening when said jaws are in the closed position, wherein the outside surface of said cone shaped hollow member is disposed for insertion into an opening in an elastic strap and the inside surface of the cone shaped hollow member allows an oversized rope to pass therethrough and be threaded through the opening in the elastic strap.

5. The tool as described in claim 4 wherein said upper jaw attachment slidably engages with said upper jaw to secure it to said plier type implement; and wherein said lower jaw attachment slidably engages with said lower jaw to secure it to said plier type implement.

6. The tool as described in claim 4 wherein the upper jaw attachment includes a set screw for securing the upper jaw attachment in a non-movable position to said upper jaw of said plier type implement; and wherein the lower jaw attachment includes a set screw for securing the lower jaw attachment in a non-movable position to said lower jaw of said plier type implement.

7. The tool as described in claim 4 wherein the upper and lower jaw of the plier have an enlarged flange extending therefrom adapted to matingly receive channels formed in the upper and lower jaw attachments.

8. The tool as described in claim 4 wherein the plier type implement is a locking plier pivotally connected at its central portion and further including handles at its rearward portions.

9. The tool as described in claim 4 wherein said upper jaw attachment further includes a slot extending from said opening for ease of removal of the threaded rope.

* * * * *